US006036604A

United States Patent [19]

Klitsner

[11] Patent Number: 6,036,604

[45] Date of Patent: Mar. 14, 2000

[54] CHILDREN'S ACTIVITY TOY

[75] Inventor: Daniel Klitsner, Larkspur, Calif.

[73] Assignee: Hedstrom Corporation, Bedford, Pa.

[21] Appl. No.: 09/131,821

[22] Filed: Aug. 10, 1998

[51] Int. Cl.[7] ..... A63G 13/08

[52] U.S. Cl. ..... 472/103; 472/105; 297/181

[58] Field of Search ..... 472/95, 99, 100, 472/101, 103, 104, 105; 297/181, 274, 256.1, 256.16, 195.11, 136

[56] References Cited

U.S. PATENT DOCUMENTS

| | | | |
|---|---|---|---|
| 2,400,396 | 5/1946 | Denton | 297/181 |
| 3,224,723 | 12/1965 | Moore | 472/105 X |
| 4,575,072 | 3/1986 | Russell | 472/103 |
| 4,693,466 | 9/1987 | Swengel, Sr. | 472/105 |
| 5,364,161 | 11/1994 | Liu | 297/195.11 |

*Primary Examiner*—Kien T. Nguyen
*Attorney, Agent, or Firm*—Cesari and McKenna, LLP

[57] ABSTRACT

A children's activity toy, preferably in the form of a spring horse having a body composed of mirror-image, front and rear sections connected by a relatively narrow, downwardly curved bridging section which can serve as a seat for an infant or toddler. The body also includes a pair of mirror-image blocks which are pivotally connected between the front and rear sections so that they can be moved between corresponding outer positions wherein they cooperate with the first and second sections to form a ring which encircles a child straddling the bridging section and corresponding inner positions wherein the blocks cooperate to form a saddle extending above the first and second sections directly over the bridging section for supporting an older child. The toy also includes means for releasably retaining blocks in their corresponding first and second positions.

11 Claims, 4 Drawing Sheets

CHILDREN'S ACTIVITY TOY

This invention relates to a children's activity toy. It relates especially to a children's bouncer or spring ride that can be used by both toddlers and older children.

BACKGROUND OF THE INVENTION

A children's bouncer usually comprises a base and a seat of some type which is suspended from the base by springs so that a child sitting in the seat can bounce up and down. One problem with prior activity toys of this general type is that a particular toy can only be used by a child within a relatively narrow age range. In other words, an activity toy such as a spring ride suitable for an infant or toddler may not be suitable for an older child who can walk without assistance. Among the reasons for this are that a toddler's legs are shorter than those of an older child. Therefore, the seat must be closer to the floor. Also, a toddler requires more restraint to ensure that the infant does not fall out of the seat. As a result, there is usually a definite differentiation between an infant's play seat such as a bouncer and the bouncing toys designed for older children. Since the stocking and the storage of these two different toys require extra space, it would be desirable to be able to provide a single activity toy which could be utilized by toddlers and older children, particularly those who reside in the same household.

SUMMARY OF THE INVENTION

Accordingly, it is an object of the present invention to provide a children's activity toy in the nature of a bouncer which can be used by toddlers as well as older children.

Another object of the invention is to provide a toy of this type which can be converted from a bouncer/walker-type toy to a resilient ride-on toy so that the same toy will suit a child as he/she grows older.

A further object of the invention is to provide an activity toy of this type which will safely accommodate an infant as well as an older child.

Another object of the invention is to provide a children's activity toy which is relatively inexpensive to manufacture.

Yet another object of the invention is to provide such a toy which can be sold in a knock-down condition and assembled by the purchaser without any special tools.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, the subject activity toy comprises a seating platform which is supported on a stable base by way of springs. When the base is resting on the floor or ground, a child sitting on the seating platform can bounce up and down above the support surface.

Preferably, the seating platform has a fanciful shape or appearance, e.g., a pony. In any case, the platform comprises a pair of front and rear, mirror-image, semicircular suctions connected by a bridging section in the form of an inverted arch. The semicircular sections are connected by the springs to the base. If the seating platform does simulate a pony, a head may project up from the front section and a tail may extend from the rear section. The bridging section provides a seat for an infant or toddler positioned in the toy with his/her legs straddling that section which extends down far enough so that the child's feet can touch the floor or other support surface under the toy.

In order to protectively enclose a small child straddling the bridging section, the seating platform also includes a pair of mirror-image blocks mounted between the front and rear semicircular sections of the seating platform at opposite sides of the platform. These blocks are shaped so that the blocks define, along with the front and rear sections of the platform, a vertical opening with relatively high walls which walls effectively surround and restrain an infant or small child straddling the bridging section so that the child cannot fall or climb out of the toy.

It is a feature of the invention that the two blocks may be moved to raised positions over the bridging section wherein they cooperate to form a solid saddle between the semicircular sections of the platform upon which an older child can sit and bounce up and down as he/she would on a conventional spring horse designed specifically for older children. Thus, the same toy can replace the two different activity toys heretofore provided for younger and older children.

As we shall see, the spring toy described herein comprises relatively few parts which are relatively inexpensive to make in quantity. Also, they can be assembled by the average purchaser with minimum effort. Therefore, the bouncer should prove to be a very marketable toy product.

BRIEF DESCRIPTION OF THE DRAWINGS

For a fuller understanding of the nature and objects of the invention, reference should be has to the following detailed description taken in connection with the accompanying drawings, in which.

DETAILED DESCRIPTION OF THE PREFERRED EMBODIMENT

Figure 1:
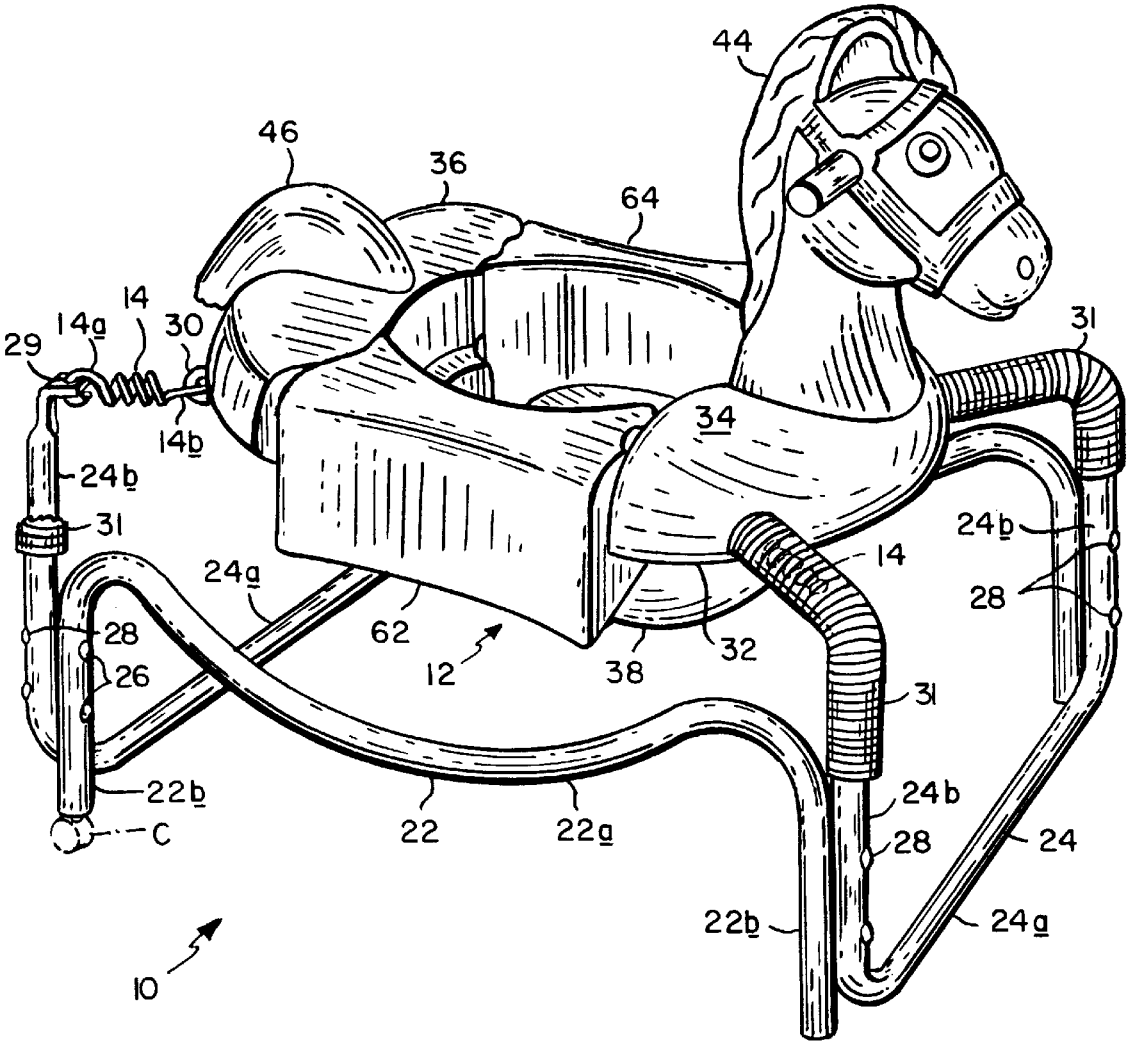
FIG. 1 is a right, front prospective view of a children's activity toy incorporating the invention and adapted to accommodate an infant or toddler.

Referring to FIG. 1 of the drawings, the activity toy comprises a base shown generally at 10 which supports a seating platform indicated generally at 12 by way of a plurality of, e.g., four, coil springs 14, so that platform 12 is resiliently supported above the support surface under base 10.

Base 10 is a rigid tubular metal structure consisting of a pair of identical side rails 22 each having a downwardly bowed bridging section 22*a* and a pair of downturned vertical legs 22*b*. Those rails are spaced parallel to one another with that parallelism being maintained by a pair of identical inverted U-shaped cross braces 24 each consisting of a bridging section 24*a* and a pair of upturned legs 24*b*. The cross brace legs 24*b* are connected to the adjacent rail legs 22*b* by threaded fasteners 26 extending through the legs 24*b* and nuts 28 screwed onto the ends of the fasteners. The lower ends of the rail legs 22*b* and the bridging sections 24*a* of the cross braces all lie on the same plane so that when base 10 lies on a relatively regular support surface such as a floor, the base forms a stable frame-like support for the seating platform 12.

A hole or eye 29 is formed in the upper end of each cross member leg 24_b_ which end is flattened and bent toward platform 12. The coil springs 14 have end hooks 14_a_ which hook through the eyes 29 in the legs 24_b_ at the four corners of base 10. Hooks 14_b_ at the opposite ends of springs 14 hook around eye bolts 30 fastened to the four corners of the seating platform 12. Preferably, flexible sleeves 31 are engaged around the springs 14 so that the springs and their connections to the base 10 and platform 12 are shielded from children playing with the toy.

Figure 3:
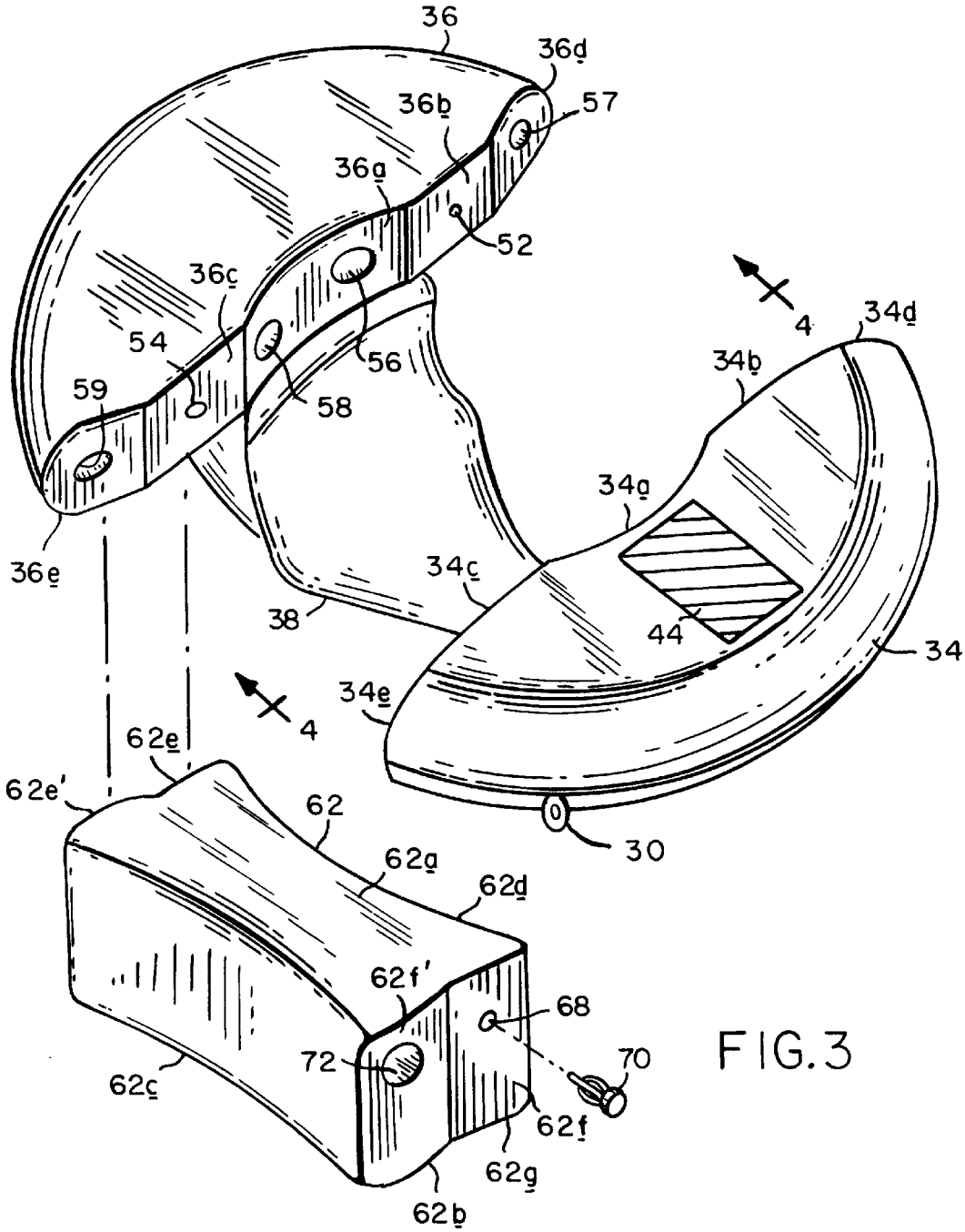
FIG. 3 is an exploded perspective view with parts broken away showing the seating platform of the FIGS. 1 and 2 toy in greater detail.

Referring to FIGS. 1 and 3, the seating platform 12 comprises a molded plastic body 32 consisting of spaced-apart, mirror-image, generally semicircular, front and rear sections 34 and 36. These sections are connected integrally by a relatively narrow, downwardly curved or bowed bridging section 38 which can serve as a seat for an infant or toddler. The bridging section 38 extends close enough to the floor or other support surface under base 10 that when the infant straddles bridging section 38, the child's feet can touch the floor.

The seating platform 12 specifically described herein is intended to simulate a house or pony. Therefore, the platform includes a simulated plastic head 44 projecting up from the body section 34 and a simulated tail 46 extending rearwardly on body section 36. Both the head and the tail may be secured to their respective body sections from below by suitable fasteners (not shown).

Referring now to FIG. 3, a forwardly facing, relatively straight edge of the rear semi-circular body section 36 has a central arcuate segment 36_a_ which is curved inwardly and has more or less the same length as the width of each end of the body's bridging section 38. On opposite sides of that segment 34_a_ are a pair of co-planar rectangular segments 36_b_ and 36_c_ and outboard those segments 36_b_ and 36_c_ is a pair of mirror-image end segments 36_d_ and 36_e_ which are angled rearwardly or away from the bridging section 38.

Body section 34, being substantially a mirror-image of section 36, has a similar arcuate segment 34_a_ bracketed by co-planar sections 34_b_ and 34_c_ and mirror-image outboard segments 34_d_ and 34_e_ which are angled back from bridging section 38.

In accordance with the invention, a pair of small holes 52 and 54 are present in segments 36_b_ and 36_c_, respectively, of body section 36. Also, a pair relatively large dimples 56 and 57 is formed in the edge segments 36_a_ and 36_d_ on opposite sides of hole 52. A similar pair of dimples 58 and 59 is formed in edge segments 36_a_ and 36_e_ on opposite sides of hole 54.

Similar holes 52 and 54 and dimples 56 to 59 are present in the rear edge of the body section 34 directly opposite their counterparts in body section 36.

Referring to FIGS. 1 and 3, in addition to body 34, the seating platform includes a pair of mirror-image blocks 62 and 64 movably attached to body 32 between sections 34 and 36 thereof. As shown in FIG. 3, block 62 is a molded plastic part having a top wall 62_a_, a bottom wall 62_b_, a relatively flat sidewall 62_c_ and a concave sidewall 62_d_. Those walls 62_a_ to 62_d_ are connected by mirror-image end walls 62_e_ and 62_f_. Also, the edge 62_g_ between walls 62_b_ and 62_d_ is gently rounded for reasons that will become apparent. As best seen in FIG. 3, small holes 68 are formed in the end walls 62_e_ and 62_f_.

As also shown in FIG. 3, the portions 62_é_ and 62_f_ of the end walls 62_e_, 62_f_ adjacent to the sidewall 62_c_ are extended and rounded to some extent with that curvature corresponding more or less to the curvature of wall segments 34_a_ and 36_a_ in body sections 34 and 36 described above.

The block 62 as depicted in FIG. 3 is arranged to be pivotally connected to body 32 by inserting the block between the body sections 34 and 36 such that the holes 68 at the ends of the block are positioned directly opposite the holes 54 in the two body sections. Then, a jacknut 70 (FIG. 3) or other suitable fastener is inserted through each pair of holes 54, 68 to pivotally connect the block 62 to the body so that the block can pivot between a first or outer operative position shown in FIG. 1 and FIG. 4 (in phantom) and a second or inner operative position illustrated in FIG. 2 and in FIG. 4 (solid lines). In the first position, the block 62 lies close to the bridging section 38 of body 32 and its curved wall 62_d_ faces toward the center of body 32. Block 62 is releasably retained in this position by the engagement of the bosses 72 on the ends of the block in the dimples 59 in the wall segments 34_e_ and 36_e_ of body sections 34 and 36, respectively.

Figure 2:
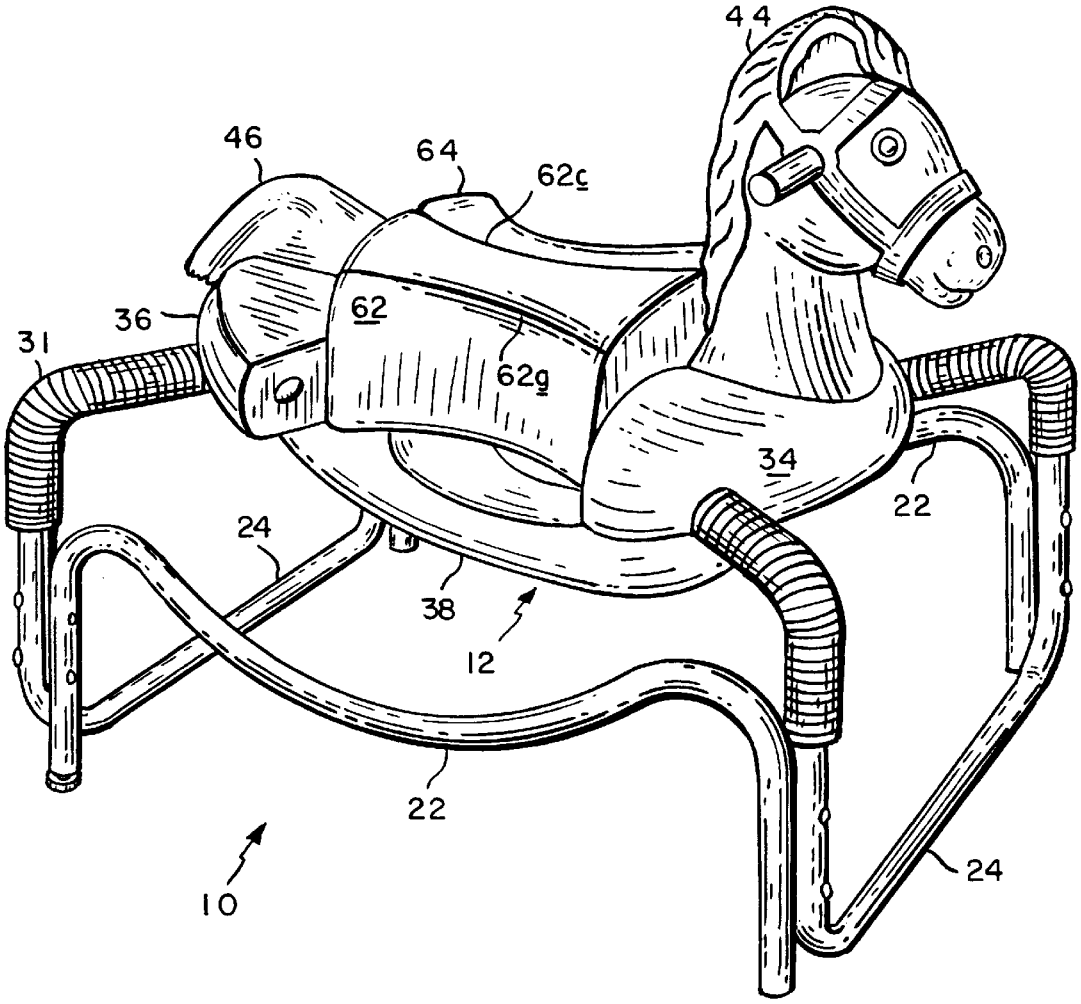
FIG. 2 is a similar view of the same toy arranged to support an older child.
Figure 4:
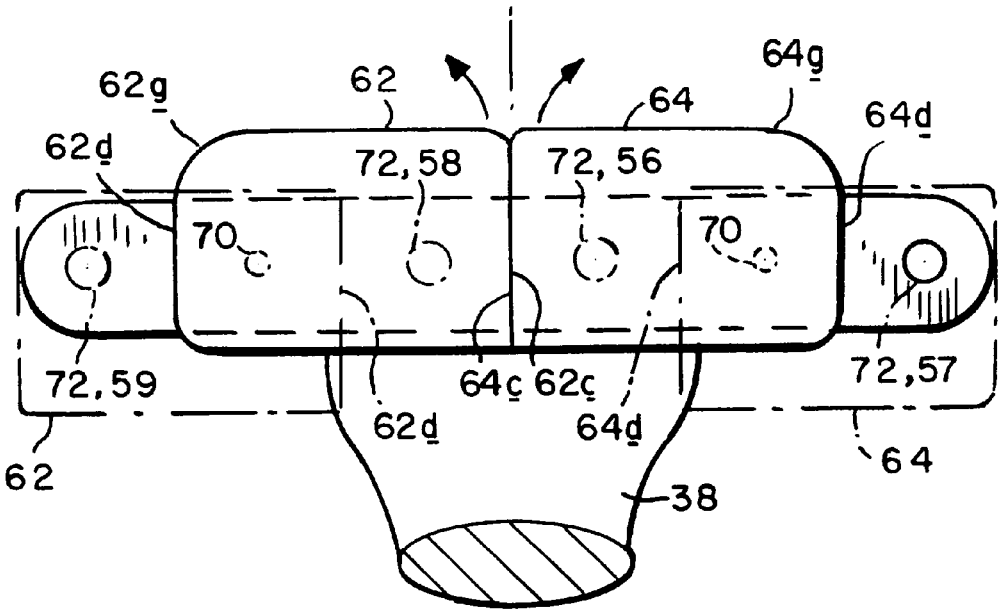
FIG. 4 is a sectional view taken along line 4—4 of FIG. 3 showing the two different operative configurations of the FIGS. 1 and 2 activity toy.

In the other operative position of block 62 shown in FIG. 2 and in FIG. 4 (solid lines), the block is raised upward from the bridging section 38 of body 32 and the curved wall 62_d_ of the block faces outward to the side of the body with the rounded edge 62_g_ of the block being located at the top of the block. Also, the straight wall 62_c_ of the block is now located near the longitudinal centerline of body 32. The block is releasably retained in this position by the engagement of the bosses 72 at the ends of the block in the dimples 58 in the wall segments 34_a_ and 36_a_ of body sections 34 and 36.

The block 64 being a mirror-image of block 62 is similarly pivotally connected to the body 34 and operates in exactly the same way. In other words, it can be pivoted between an outer position shown in FIGS. 1 and 4 and an inner position shown in FIGS. 2 and 4 and is releasably retained in each of those operative positions by engagement of bosses 72 at the ends of block 64 in the dimples 57 and 56 in body sections 34 and 36, respectively.

When the two blocks 62 and 64 are in their outer positions illustrated in FIG. 1, they form with the body sections 34 and 36, ring having a relatively large vertical opening directly above the bridging section 38 of the body. That opening has relatively high walls which completely encircle a small child sitting on and straddling the bridging section 38 thereby preventing the child from falling from the seating platform. It should be mentioned in this connection that the curved walls 62_d_ and 64_d_ of blocks 62 and 64 are so positioned relative to the bridging section 38 that sufficient clearance is provided for the child to sit on and straddle section 38. However, not so much clearance space is present as to allow the child to fall down through the bottom of the seating platform 12.

On the other hand, when the two blocks 62 and 64 are moved to their inner positions shown in FIG. 2, they combine to form a solid rounded saddle directly above the is bridging section 38 which saddle is raised above the bridging section sufficiently to allow an older child to sit on the saddle with his/her feet on the side rails 22 or the underlying support surface. By pressing down with his/her feet the child can move up and down and to and fro to simulate the motion of a bucking horse.

Thus, the novel seating platform 12 in the activity toy described herein enables the same toy to be used by a child as the child grows older or to be used by a younger sibling of an older child for whom the toy was bought in the first place. The components of the toy can be assembled using a simple screwdriver and the blocks 62 and 64 can be assembled to body 32 to complete the seating platform simply by forcing them into place between the two sections 34 and 36 of body 32 as described above.

It will thus be seen that the objects set forth above, among those made apparent from the preceding description, are efficiently attained. Also, certain changes may be made in the above construction without departing from the scope of the invention. For example, conventional wheels or castors may be mounted to the ends of rail legs 22_b_ as shown in phantom at C in FIG. 1 so that the toy can function as a walker as well as a bouncer. Also, instead of pivotally connecting blocks 62, 64 to body sections 34, 36 using the jacknuts 70, the blocks may be connected to those sections using conventional axles or bolts extending through the ends of the blocks and body section wall segments 34_c_, 36_c_. Therefore, it is intended that all matter contained in the above description or shown in the accompanying drawings shall be interpreted as illustrative and not in a limiting sense.

It will also be understood that the following claims are intended to cover all of the generic and specific features of the invention described herein.

What is claimed is:

1. A children's activity toy comprising a base having a bottom, and a seating platform supported by the base, said seating platform including a first section having ends, a second section having ends, a bridging section extending between the first and second sections, said bridging section being at a selected elevation above the bottom of the base and forming a seat, first and second blocks each having opposite ends, means for pivotally connecting the first and second blocks between the first and second sections above the bridging section so the blocks can be moved between corresponding outer positions wherein the blocks define with the first and second sections a relatively large ring centered over the seat for encircling a young child sitting on the seat and corresponding inner positions wherein said blocks cooperate to form a saddle which extends above the first and second sections directly over the bridging section for supporting an older child, first retaining means for releasably retaining the blocks in their corresponding outer positions, and second retaining means for releasably retaining the blocks in their corresponding inner positions.

2. The toy defined in claim 1 wherein the base includes a plurality of springs connected to the seating platform so that the seating platform is supported resiliently.

3. A toy defined in claim 2 and further including wheels mounted to the bottom of the base.

4. A toy defined in claim 1 wherein the blocks are mirror-images of one another.

5. The toy defined in claim 1 wherein the connecting means comprise fastener means extending between the opposite ends of the first block and the first and second sections, respectively, and additional fastener means extending between the opposite ends of the second block and the first and second sections, respectively.

6. The toy defined in claim 1 wherein the first retaining means comprise interfitting portions of the opposite ends of the blocks and of the first and second sections adjacent to the ends thereof, and the second retaining means comprise interfitting portions of the opposite ends of said blocks and of the first and second sections inboard the portions thereof comprising a first retaining means.

7. The toy defined in claim 1 wherein the first and second sections and the bridging section comprise a single, hollow molded plastic part.

8. The toy defined in claim 7 wherein the blocks each comprise a hollow, molded plastic part.

9. The toy defined in claim 7 and further including a molded, plastic simulated animal head affixed to the first section, and a molded plastic simulated tail affixed to the second section.

10. The toy defined in claim 1 wherein the base includes a pair of mirror-image side rails, each having opposite ends being and spaced parallel to one another, and a pair of mirror-image cross braces connected between corresponding ends of the side rails.

11. The toy defined in claim 1 wherein the bridging section comprises an inverted arch.

* * * * *